United States Patent [19]

Edwards

[11] 3,980,116

[45] Sept. 14, 1976

[54] ORGANIZER FOR PURSE, HANDBAG OR THE LIKE

[76] Inventor: Edna H. Edwards, 1100 Chantilly Road, Los Angeles, Calif. 90024

[22] Filed: Sept. 22, 1975

[21] Appl. No.: 615,574

[52] U.S. Cl. ..... 150/30; 190/51

[51] Int. Cl.[2] ..... A45C 13/02

[58] Field of Search ..... 150/30, 31, 28 R, 35; 211/164; 190/51

[56] References Cited

UNITED STATES PATENTS

| | | | |
|---|---|---|---|
| 2,261,806 | 11/1941 | Hills | 190/51 |
| 2,429,856 | 10/1947 | Vasquez | 150/28 R |
| 2,529,569 | 11/1950 | Overton | 190/51 |
| 2,799,316 | 7/1957 | Cohen | 150/28 R |
| 2,893,457 | 7/1959 | Wilson | 150/30 |
| 2,962,156 | 11/1960 | Adams | 211/164 X |
| 3,128,854 | 4/1964 | Specht | 190/51 |

FOREIGN PATENTS OR APPLICATIONS

| | | | |
|---|---|---|---|
| 462,120 | 11/1913 | France | 211/164 |
| 333,105 | 12/1935 | Italy | 28 R/ |

*Primary Examiner*—Herbert F. Ross
*Attorney, Agent, or Firm*—Keith D. Beecher

[57] ABSTRACT

A rotatable organizer assembly is provided which can be detachably or non-detachably mounted in a receptacle, such as a purse, handbag, luggage, or the like, and which provides a plurality of separate compartments within the receptacle, and which may be turned so that each of the compartments may be readily brought to an accessible position.

9 Claims, 9 Drawing Figures

ORGANIZER FOR PURSE, HANDBAG OR THE LIKE

BACKGROUND OF THE INVENTION

Most luggage, handbags, purses, and the like, provide merely a single receptacle in which a wide variety of items are carried in a jumbled condition. Accordingly, it is often difficult to retrieve any particular item quickly and efficiently from such receptacles.

The organizer of the present invention solves the problem inherent in the use of such luggage, handbags and purses by providing an organizer assembly in the form of a multi-compartment rotatable insert which can be easily turned to permit access to each of its compartments. With the organizer of the invention, nothing gets lost in the bottom of the bag, since, in effect, the bag does not have a bottom because the organizer provides that all the contents of the bag may be quickly rotated to the top so as to be immediately accessible.

The organizer of the invention may be provided with two or more compartments, as desired. The organizer may be removable so that all the contents of a particular bag may be quickly transferred to a different bag, as desired. As will be described, the organizer may be of a variety of shapes and sizes to fit different types of bags. In any event, and as will be described, the shape of the organizer need not dictate the exterior shape of the bag itself.

DETAILED DESCRIPTION OF THE ILLUSTRATED EMBODIMENTS

Figure 1:
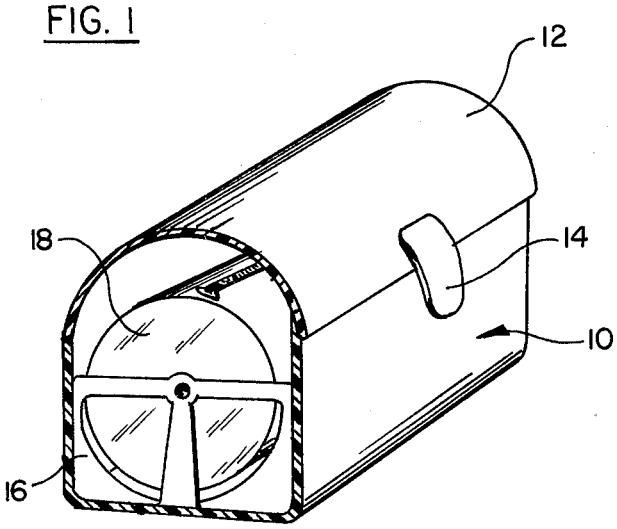
FIG. 1 is a perspective representation of a typical handbag, with a section through one end to reveal an organizer insert in the bag, constructed in accordance with one embodiment of the invention.

The handbag shown in FIG. 1 has a "breadbox" shape, and is formed, for example, of leather, plastic, or the like. The handbag is designated generally as 10, and it has an upper flap 12 which is normally held closed by a fastener 14, but which may be opened to permit access to the interior of the handbag.

An organizer insert member, constructed in accordance with the concepts of the invention is supported within the handbag 10. The insert includes a frame having a pair of end members, such as the end member 16 which are supported within the handbag adjacent to the ends thereof. A hollow cylindrical-shaped member 18 is rotatably mounted in the frame between the end members 16. It will be appreciated from the representation of FIG. 1 that the cylindrical shape of the insert does not necessarily dictate the external shape of the handbag itself.

Figure 2:
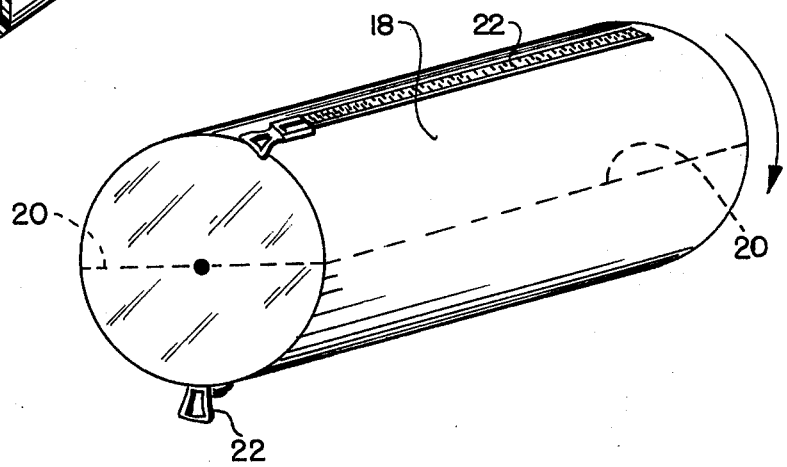
FIG. 2 is a perspective representation of a multicompartment cylindrical member forming one of the components of the insert of FIG. 1.

As shown in FIG. 2, the hollow cylindrical member 18 may be divided by internal radially extending walls 20 into two or more segmented internal compartments. Zippers, such as the zipper 22 are provided along the side of the cylindrical member to permit access to each of the internal compartments.

The frame and rotatable cylindrical components of the insert shown in FIGS. 1 and 2 may be formed, for example, of light metal or appropriate plastic. The frame may be removable from the bag 10, so that it, and its contents, may be quickly transferred to other bags, as desired. The cylindrical member 18 may, for example, be formed of a transparent plastic material, so that the contents of each of the compartments may be observable. Then, when in use, the purse may be opened, the internal cylindrical member 18 may be turned to the compartment containing the desired article, the corresponding zipper 22 is opened, and the article is retrieved.

Figure 3:
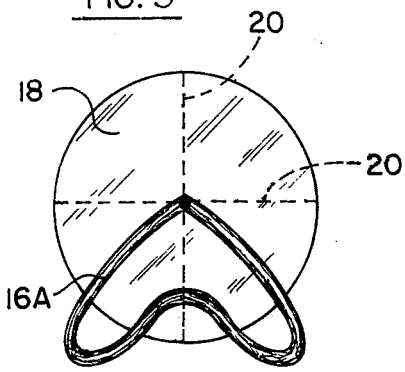
FIGS. 3 and 4 are end views showing various types of configurations which may be used for the frame of the insert.
Figure 4:
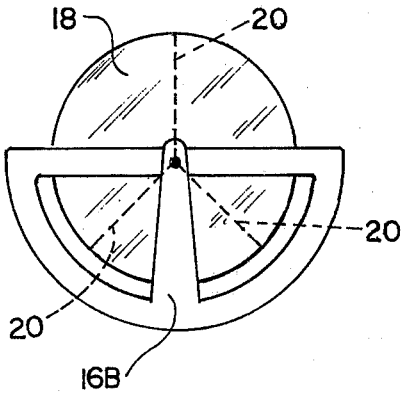

The end members of the frame of the insert may have other shapes, such as designated 16A and 16B in FIGS. 3 and 4, to fit other types of handbags.

Figure 5:
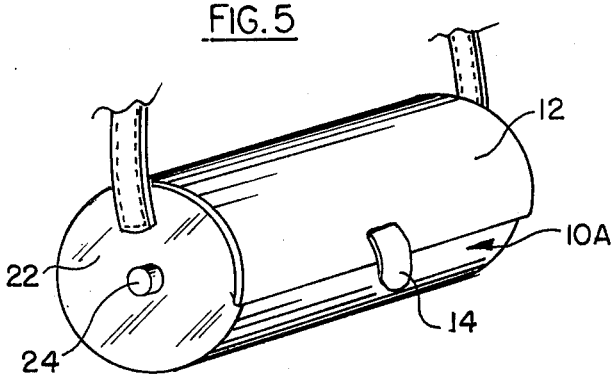
FIG. 5 shows a cylindrical-shaped handbag in which a cylindrical organizer insert, in accordance with one embodiment of the invention, may be permanently mounted.
Figure 6:
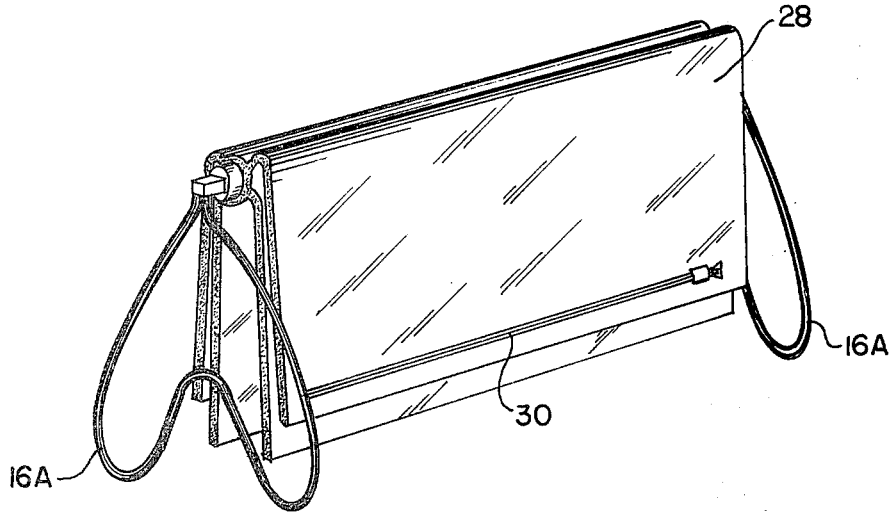
FIG. 6 is a perspective representation of another embodiment of the invention, in which the multi-compartment organizer insert member takes the form of a plurality of flexible transparent envelopes.
Figure 7:
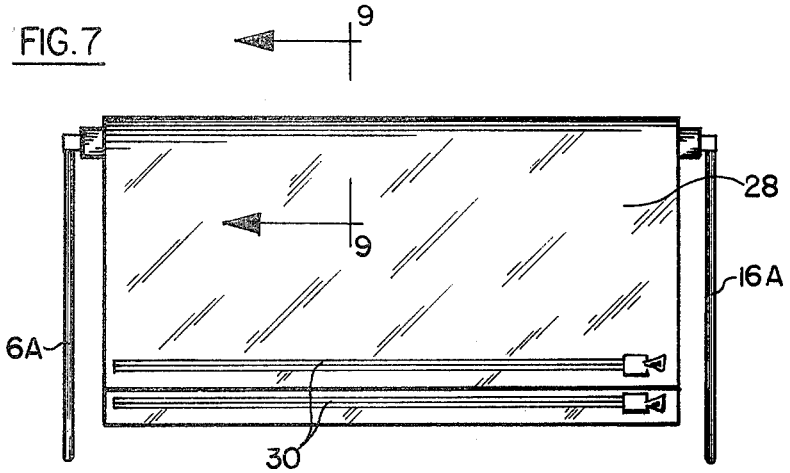
FIG. 7 is a side elevation of the embodiment of FIG. 6.
Figure 8:
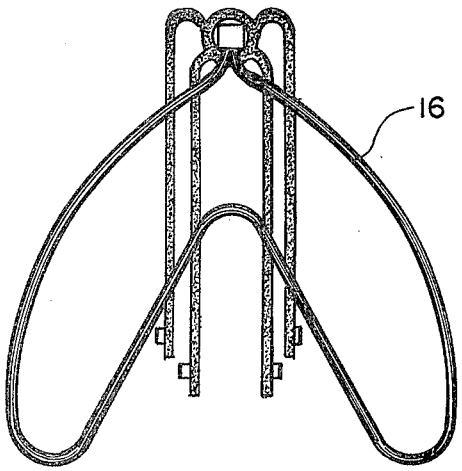
FIG. 8 is an end elevation of the embodiment of FIG. 6.

As shown in FIG. 5, the organizer insert member may be permanently formed inside the handbag, such as the handbag 10A on a central rod which is secured to the ends 22 of the handbag by appropriate fittings such as the fitting 24. The handbag of FIG. 5, for example, may be formed of attractive fabric material with hard leather ends, and the fittings 24 may be formed as decorative brass fittings.

Figure 9:
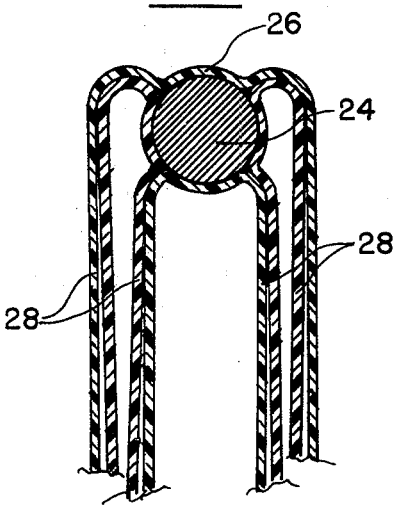
FIG. 9 is a section taken substantially on the line 9—9 of FIG. 7.

In the embodiment of FIGS. 6-9, the illustrated frame includes the end members 16A shown in FIG. 3, and it also includes a rod 24 extending between the end members. The multicompartment rotatable member in the latter embodiment includes a tubular member 26 which is rotatably mounted on the rod 24, and it includes a plurality of flexible envelopes 28, each of which has its upper edge attached to the tubular member 24, as best shown in FIG. 9. Each of the envelopes 28 has a zipper 30 formed therein to permit access to the individual envelopes.

As in the previous embodiment, the organizer insert assembly of FIGS. 6–9 may be turned within the purse until a desired envelope 28 is accessible, at which time its zipper may be opened to insert or withdraw a desired article. The envelopes 28 may be formed of an appropriate transparent flexible plastic material, so that their contents may be observable.

The invention provides, therefore, improved organizer insert assemblies which may be built into the interior of a handbag, or which may be detachably positioned within the handbag, and which permit the contents of the handbag to be held in different compartments that may readily be turned to an accessible position.

While particular embodiments of the invention have been shown and described, modifications may be made. It is intended in the claims to cover the modifications which come within the spirit and scope of the invention.

What is claimed is:

1. In combination: an organizer insert and a receptacle, such as a purse, handbag, luggage, and the like, said receptacle having first and second ends with an openable closure means therebetween, said insert comprising an enclosed compartmented rotatable member rotatably mounted in the receptacle about its axis extending between the ends of the receptacle and having a plurality of internal compartments each with an opening therein to permit access to the interior thereof, and additional closure means for each of the openings, said insert further includes a rigid frame adapted to fit into the receptacle, said frame having a pair of end brackets adapted to be positioned adjacent to the respective ends of the receptacle, and in which said rotatable member is rotatably mounted on the frame between the end brackets thereof.

2. The combination defined in claim 1, in which the additional closure means each comprises a zipper.

3. The combination defined in claim 1, in which said rotatable member has a cylindrical shape, and in which said rotatable member has internal radial walls dividing the interior thereof into a plurality of segments to form said internal compartments.

4. The combination defined in claim 1, in which the frame is removable from the receptacle.

5. The combination defined in claim 1, in which said insert further includes a frame adapted to fit into the receptacle, said frame having a pair of end brackets adapted to be positioned adjacent to the respective ends of the receptacle, and in which said rotatable member is rotatably mounted on the frame between the end brackets thereof.

6. The combination defined in claim 1, in which said rotatable member is formed of a plurality of flexible envelopes.

7. The combination defined in claim 1, in which said frame includes a rod interconnecting said end brackets, and in which said rotatable member is rotatably mounted on said rod.

8. The combination defined in claim 7, in which said rotatable member includes a central tubular portion rotatably mounted coaxially on said rod, and in which said rotatable member further includes a plurality of flexible envelopes positioned between the end brackets to form the individual compartments, each of the envelopes having an opening therein, and each having an upper edge attached to the tubular portion.

9. The combination defined in claim 8, in which each of the envelopes has a zipper thereon to form an adjustable enclosure for the corresponding opening therein.

* * * * *